US008914144B2

(12) United States Patent
Abe

(10) Patent No.: US 8,914,144 B2
(45) Date of Patent: Dec. 16, 2014

(54) SEWING MACHINE, APPARATUS, AND NON-TRANSITORY COMPUTER-READABLE MEDIUM

(75) Inventor: Daisuke Abe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 279 days.

(21) Appl. No.: 13/564,245

(22) Filed: Aug. 1, 2012

(65) Prior Publication Data

US 2013/0035780 A1 Feb. 7, 2013

(30) Foreign Application Priority Data

Aug. 4, 2011 (JP) ..... 2011-170622

(51) Int. Cl.

| | |
|---|---|
| ***D05C 5/02*** | (2006.01) |
| ***D05B 19/08*** | (2006.01) |
| ***D05B 19/10*** | (2006.01) |
| ***D05C 5/04*** | (2006.01) |

(52) U.S. Cl.

CPC ..... *D05B 19/08* (2013.01); *D05B 19/10* (2013.01); *D05C 5/04* (2013.01)

USPC ..... 700/138; 112/470.01

(58) Field of Classification Search

USPC ..... 700/136–138; 112/102.5, 470.01, 112/470.04, 470.06, 475.18, 475.19

See application file for complete search history.

(56) References Cited

U.S. PATENT DOCUMENTS

| | | | | |
|---|---|---|---|---|
| 4,991,524 | A * | 2/1991 | Ozaki | 112/102.5 |
| 5,386,789 | A * | 2/1995 | Futamura et al. | 112/102.5 |
| 5,558,031 | A * | 9/1996 | Muto et al. | 112/102.5 |
| 5,563,795 | A | 10/1996 | Futamura et al. | |
| 5,740,056 | A * | 4/1998 | Futamura | 700/138 |
| 5,765,496 | A * | 6/1998 | Futamura | 112/102.5 |
| 5,791,271 | A | 8/1998 | Futamura | |
| 6,032,596 | A * | 3/2000 | Hayakawa | 112/102.5 |
| 6,397,120 | B1 * | 5/2002 | Goldman | 700/138 |
| 7,587,256 | B2 * | 9/2009 | Goldman | 700/138 |

FOREIGN PATENT DOCUMENTS

| | | |
|---|---|---|
| JP | A-2-133648 | 5/1990 |
| JP | A-5-42278 | 2/1993 |
| JP | A-8-44848 | 2/1996 |
| JP | A-10-118367 | 5/1998 |
| JP | A-11-76664 | 3/1999 |
| JP | A-2001-17758 | 1/2001 |

OTHER PUBLICATIONS

Jul. 16, 2013 Office Action issued in Japanese Patent Application No. 2011-170622 (with translation).

* cited by examiner

*Primary Examiner* — Nathan Durham

(74) *Attorney, Agent, or Firm* — Oliff PLC

(57) ABSTRACT

An apparatus includes a processor and a memory. The memory is configured to store computer-readable instructions therein, wherein the computer-readable instructions instruct the sewing machine to execute steps comprising acquiring image data including one or more characters, extracting, from acquired image data, one or more character designs with respect to each character included in the acquired image data, wherein the character design represents each character included in the acquired image data, generating embroidery data with respect to each character based on the extracted character design, wherein the embroidery data represents an embroidery pattern in a predetermined size.

10 Claims, 15 Drawing Sheets

SEWING MACHINE, APPARATUS, AND NON-TRANSITORY COMPUTER-READABLE MEDIUM

CROSS-REFERENCE TO RELATED APPLICATION

This application claims priority to Japanese Patent Application No. 2011-170622, filed Aug. 4, 2011, the disclosure of which is hereby incorporated by reference in its entirety.

BACKGROUND

The present disclosure relates to a sewing machine that can perform sewing of an embroidery pattern, an embroidery data creation device that creates data for sewing an embroidery pattern, and a non-transitory computer-readable medium that stores an embroidery data creation program.

A sewing machine is known that can sew an embroidery pattern based on a design that a user has selected. An embroidery data creation device is also known that creates embroidery data for sewing an embroidery pattern. Specifically, the embroidery data creation device is also known that acquires a design that a user has selected. The embroidery data creation device creates embroidery data for sewing the acquired design as an embroidery pattern. The embroidery data creation device can recognize characters in the acquired design and convert them into other characters of a different style. The embroidery data creation device is thus able to create embroidery data for sewing an embroidery pattern of a design that contains the characters of the different style.

SUMMARY

Demand has arisen to have characters of a particular style acquired in advance by a sewing machine, to have a character string created by combining the acquired characters as the user desires, and to have an embroidery pattern of the character string sewn by the sewing machine. The characters of a particular style may be characters in a handwritten style, for example. The known devices described above are not able to acquire characters of a particular style in advance. Therefore, cases may occur in which the embroidery data for sewing a character string that includes characters of a particular style cannot be created.

There may also be cases in which, after the embroidery data are created based on a character string that includes characters of a particular style, and that is acquired by the sewing machine as it is the user wants to change only a specific character within the character string to a different character and then sew the embroidery pattern.

In that case, it may be necessary for the sewing machine to acquire the entire character string once again, even if the greater part of the character string is the same, and to create the embroidery data all over again. Therefore, it may be not always be possible to create the embroidery data and perform the sewing efficiently.

Various exemplary embodiments of the general principles herein provide a sewing machine that may comprise a processor; and a memory. The memory may be configured to store computer-readable instructions therein, wherein the computer-readable instructions instruct the sewing machine to execute steps comprising acquiring image data including one or more characters, extracting, from acquired image data, one or more character designs with respect to each character included in the acquired image data, wherein the character design represents each character included in the acquired image data, generating embroidery data with respect to each character based on the extracted character design, wherein the embroidery data represents an embroidery pattern in a predetermined size, selecting specific embroidery data, in response to accepting an instruction for specifying character design, from the generated embroidery data corresponding to the specified character design, and generating a signal based on the selected embroidery data, wherein the sewing machine is configured to sew an embroidery pattern represented by the selected embroidery data based on the signal.

Exemplary embodiments herein provide an apparatus that may comprise a processor and a memory. The memory may be configured to store computer-readable instructions therein, wherein the computer-readable instructions instruct the apparatus to execute steps comprising acquiring image data including one or more characters, extracting, from acquired image data, one or more character designs with respect to each character included in the acquired image data, wherein the character design represents each character included in the acquired image data, and generating embroidery data with respect to each character based on the extracted character design, wherein the embroidery data represents an embroidery pattern in a predetermined size.

Exemplary embodiments also provide a non-transitory computer readable medium. The non-transitory computer readable medium may store computer readable instructions that, when executed, instruct an apparatus to execute steps comprising acquiring image data including one or more characters, extracting, from acquired image data, one or more character designs with respect to each character included in the acquired image data, wherein the character design represents each character included in the acquired image data, and generating embroidery data with respect to each character based on the extracted character design, wherein the embroidery data represents an embroidery pattern in a predetermined size.

BRIEF DESCRIPTION OF THE DRAWINGS

Exemplary embodiments of the present disclosure will be described below in detail with reference to the accompanying drawing in which.

DETAILED DESCRIPTION

Hereinafter, an embodiment will be explained with reference to the drawings. A configuration of a sewing machine 1 will be explained with reference to FIGS. 1 and 2. In the explanation that follows, the lower right, the upper left, the upper right, and the lower left in FIG. 1 respectively correspond to the front side, the rear side, the right side, and the left side of the sewing machine 1. A direction in which a bed 11 (described later) extends corresponds to an X-axis direction. A direction that is perpendicular to the X-axis direction and that is parallel to the top face of the bed 11 corresponds to a Y-axis direction.

Figure 1:
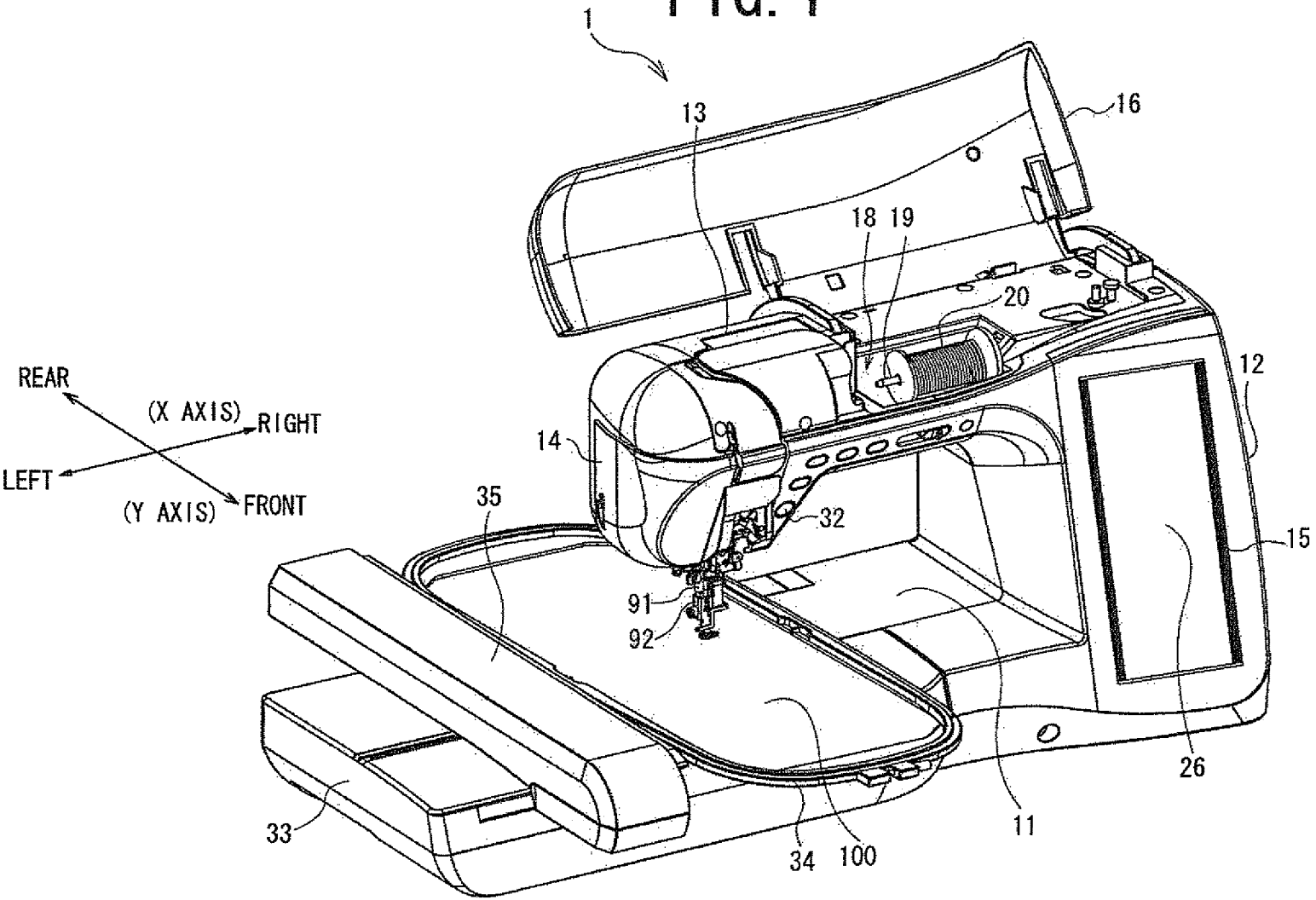
FIG. 1 is an oblique view of a sewing machine 1.

As shown in FIG. 1, the sewing machine 1 includes a bed 11, a pillar 12, an arm 13, and a head 14. The bed 11 is a base portion of the sewing machine 1 that is longer in the left-right direction. The pillar 12 extends upward from the right end of the bed 11. The arm 13 extends to the left from the upper end of the pillar 12 such that it is opposite the bed 11. The head 14 is a portion that is connected to the left end of the arm 13. A needle plate (not shown in the drawings) is provided in the top face of the bed 11. A feed dog, a feed mechanism, and a shuttle mechanism (which are not shown in the drawings), and a feed adjustment pulse motor 78 (refer to FIG. 3) are provided underneath the needle plate (that is, within the bed 11). The feed dog may be driven by the feed mechanism and feed a work cloth by a specified feed amount. The feed amount may be adjusted by the feed adjustment pulse motor 78.

An embroidery frame 34 that holds a work cloth 100 can be disposed on the top side of the bed 11. The embroidery frame 34 may be a known structure that is configured to hold the work cloth 100 by clamping it with an inner frame and an outer frame. An embroidery frame moving device 33 has a known structure that is configured to move the embroidery frame 34, so it will be explained briefly. The embroidery frame moving device 33 can be removably mounted on the bed 11. A carriage 35 that extends in the front-rear direction is provided on top of the embroidery frame moving device 33. A frame holder (not shown in the drawings) on which the embroidery frame 34 can be removably mounted and a Y axis moving mechanism (not shown in the drawings) that is configured to move the frame holder in the front-rear direction (the Y axis direction) are provided in the interior of the carriage 35. The Y axis moving mechanism may be driven by a Y axis motor 84 (refer to FIG. 3).

An X axis moving mechanism (not shown in the drawings) that is configured to move the carriage 35 in the left-right direction (the X axis direction) is provided inside the embroidery frame moving device 33. The X axis moving mechanism may be driven by an X axis motor 83 (refer to FIG. 3). As the carriage 35 is moved in the left-right direction (the X axis direction), the embroidery frame 34 is moved in the left-right direction (the X axis direction).

A needle bar 6 (refer to FIG. 2) and the shuttle mechanism (not shown in the drawings) may be driven in conjunction with the moving of the embroidery frame 34 in the left-right direction (the X axis direction) and the front-rear direction (the Y axis direction). This causes a sewing needle 7 (refer to FIG. 2) that is mounted in the needle bar 6 to sew an embroidery pattern in the work cloth 100 that is held by the embroidery frame 34. When an ordinary pattern that is not an embroidery pattern is to be sewn, the embroidery frame moving device 33 is removed from the bed 11. In that state, the sewing is performed as the work cloth is moved by the feed dog.

A vertically rectangular liquid crystal display (hereinafter called an LCD) 15 is provided in the front face of the pillar 12. An image may be displayed on the LCD 15 based on image data that includes various types of items, such as commands, illustrations, setting values, messages, and the like. A touch panel 26 is provided on the front face of the LCD 15. Using a finger or a special touch pen, a user may perform a pressing operation on the touch panel 26. Hereinafter, this operation is called a panel operation. The touch panel 26 detects a position which is pressed by a finger or a special touch pen etc., and the sewing machine 1 determines the item that corresponds to the detected position. Thus, the sewing machine 1 recognizes the selected item. By performing the panel operation, the user can select a pattern to be sewn or a command to be executed.

The arm 13 is provided in its top portion with a cover 16 that can be opened and closed. Underneath the cover 16, that is, approximately in the middle of the arm 13, a thread container portion 18 is provided that is a recessed portion that may contain a thread spool 20. A thread spool pin 19 that projects leftward toward the head 14 is provided on an inner side wall on the pillar 12 side of the thread container portion 18. The thread spool 20 may be mounted in the thread container portion 18 in a state in which the thread spool pin 19 has been inserted into an insertion hole (not shown in the drawings) of the thread spool 20.

Figure 2:
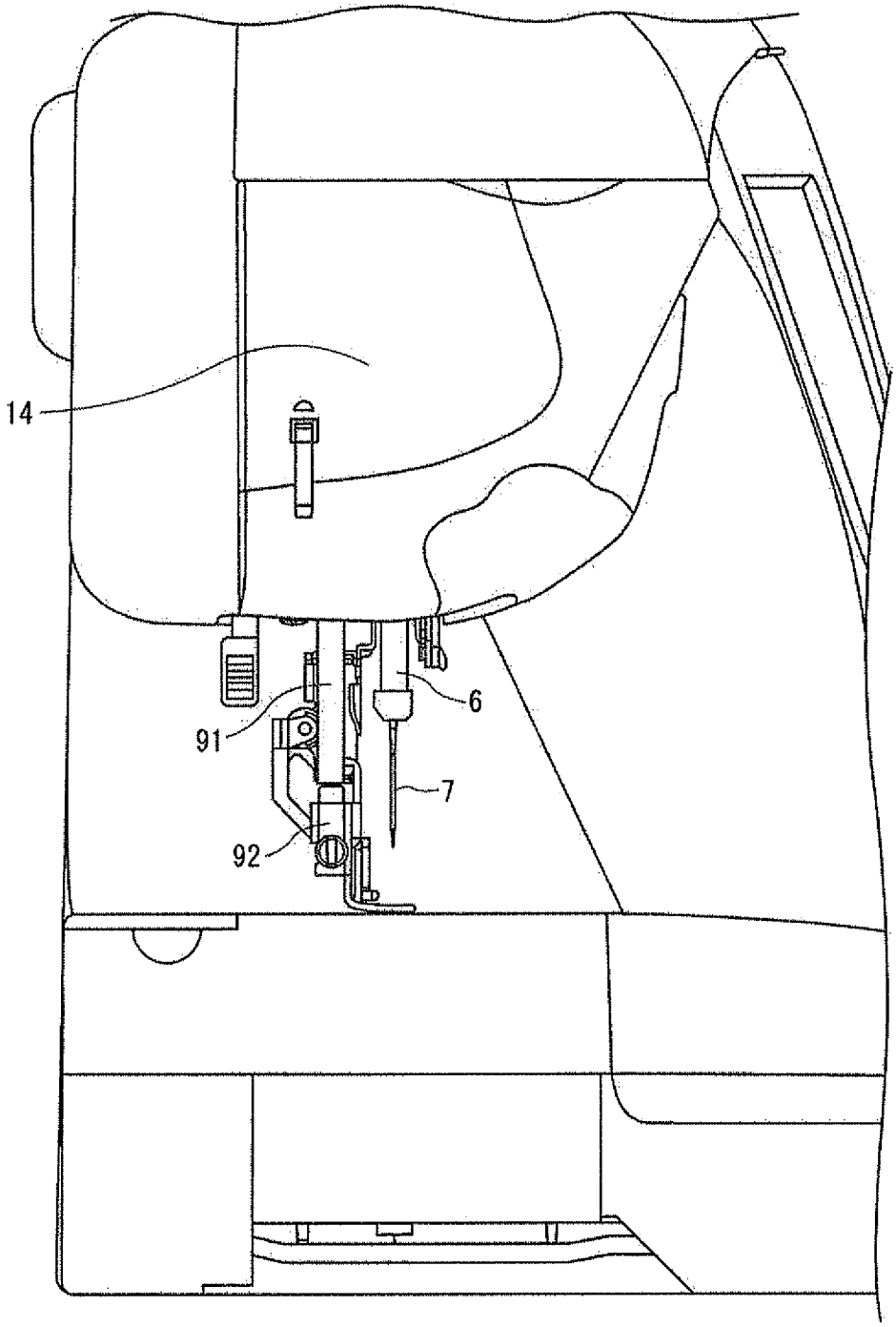
FIG. 2 is a left side view that shows an area around a needle bar 6, a sewing needle 7, a presser bar 91, and a presser foot 92.

An upper thread (not shown in the drawings) that is wound around the thread spool 20 may be supplied from the thread spool 20, through a thread hook portions (not shown in the drawings) that are provided in the head 14, to the sewing needle 7 that is mounted in the needle bar 6 (refer to FIG. 2). The needle bar 6 may be driven by a needle bar up-and-down moving mechanism (not shown in the drawings) that is provided in the head 14, such that the needle bar 6 moves up and down. The needle bar up-and-down moving mechanism may be driven by a drive shaft (not shown in the drawings) that may be rotationally driven by a sewing machine motor 79 (refer to FIG. 3). A presser bar 91 extends downward from the bottom end of the head 14. A presser foot 92 that presses down on the work cloth 100 may be replaceably mounted on the presser bar 91. A plurality of operation switches, including a start-and-stop switch 32, are provided in the lower part of the front face of the arm 13.

An electrical configuration of the sewing machine 1 will be explained with reference to FIG. 3. A control portion 60 of the sewing machine 1 includes a CPU 61, a ROM 62, a RAM 63, an EEPROM 64, an external access RAM 68, a card slot 17, an input interface 65, and an output interface 66. These elements are electrically connected to one another by a bus 67. A plurality of operation switches, including a power supply switch 31 and the start-and-stop switch 32, are electrically connected to the input interface 65, as are the touch panel 26 and the like.

The ROM 62 stores various types of programs for controlling the operation of the sewing machine 1. The CPU 61 may perform various types of computations and processing in accordance with the programs that are stored in the ROM 62, temporarily storing various types of data in the RAM 63. Standard character embroidery data are also stored in the ROM 62. The standard character embroidery data are data for sewing characters in a standard style as embroidery patterns. The standard character embroidery data may represent an embroidery data of a standard design of a character. Data that indicate needle drop points, which are positions where the sewing needle 7 pierces the work cloth 100, are also included in the standard character embroidery data. A sewing order, a sewing starting point, and a sewing ending point of an embroidery pattern are also included in the standard character embroidery data. The sewing order, the sewing starting point, and the sewing ending point will be described in detail later. Hereinafter, the sewing order, the sewing starting point, and the sewing ending point are also called setting information. The sewing machine 1 is able to sew characters in the standard style as embroidery patterns, based on the standard character embroidery data.

Figure 4:
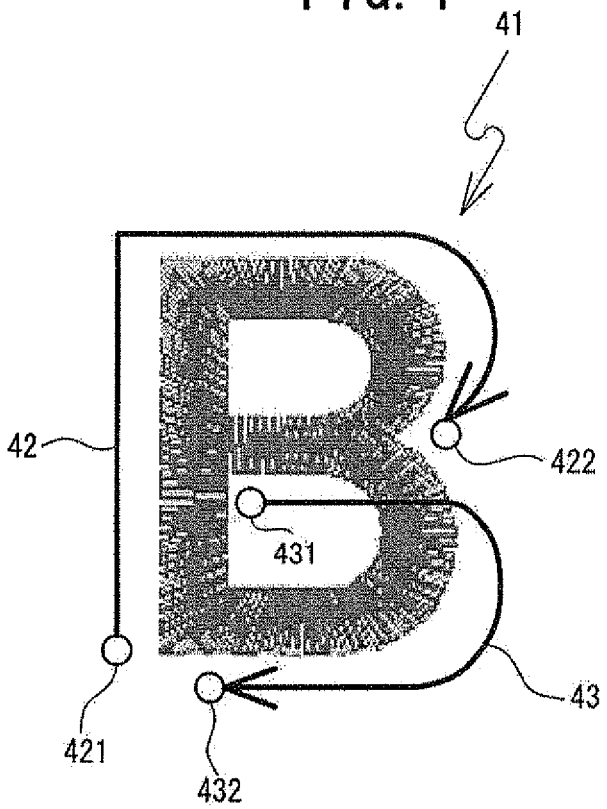
FIG. 4 is a figure that shows an embroidery pattern 41 of a character "B"

The setting information that is included in the standard character embroidery data will be explained with reference to FIG. 4. FIG. 4 shows an embroidery pattern 41 of the alphabetic character "B". The embroidery pattern 41 of the alphabetic character "B" in FIG. 4 is an example of an embroidery pattern that is sewn in the work cloth 100 (refer to FIG. 1) based on the standard character embroidery data. The embroidery pattern 41 is sewn by causing the sewing needle 7 to pierce the work cloth 100 at the needle drop points in the order that is indicated by arrows 42, 43. Information that indicates the sewing will be performed in the directions that are shown by the arrows 42, 43 and in the order indicated by the arrows 42, 43 is equivalent to the sewing order. Information that indicates a starting point 421 and an ending point 422 of the arrow 42 is equivalent to the sewing starting point and the sewing ending point, respectively. In the same manner, information that indicates a starting point 431 and an ending point 432 of the arrow 43 is also equivalent to the sewing starting point and the sewing ending point, respectively.

The setting information, that is, the sewing order, the sewing starting point, and the sewing ending point, have been adjusted such that an embroidered pattern with high quality can be sewn in the work cloth 100 based on the standard character embroidery data. Specific examples will be explained. Value of the setting information is adjusted such that jump stitches and basting occur as little as possible, or to put it another way, such that the character is sewn, to the extent possible, as if it were written as a single continuous line. Thus the high quality of the embroidered pattern may be ensured. This may prevent the occurrence of boundary lines and differences in the sewing direction within the embroidery pattern. The parameters in the setting information are also adjusted such that the sewing starts and stops on the underside of the standard character, to the extent possible. In a case where embroidery patterns of a character string in which a plurality of the standard characters are combined and sewn, this may prevent jump stitches from passing over the embroidered pattern between the embroidered patterns for the individual characters, thereby ensuring the high quality of the embroidered pattern. It may also minimize the amount of jump stitch removal work the user must do.

Figure 3:
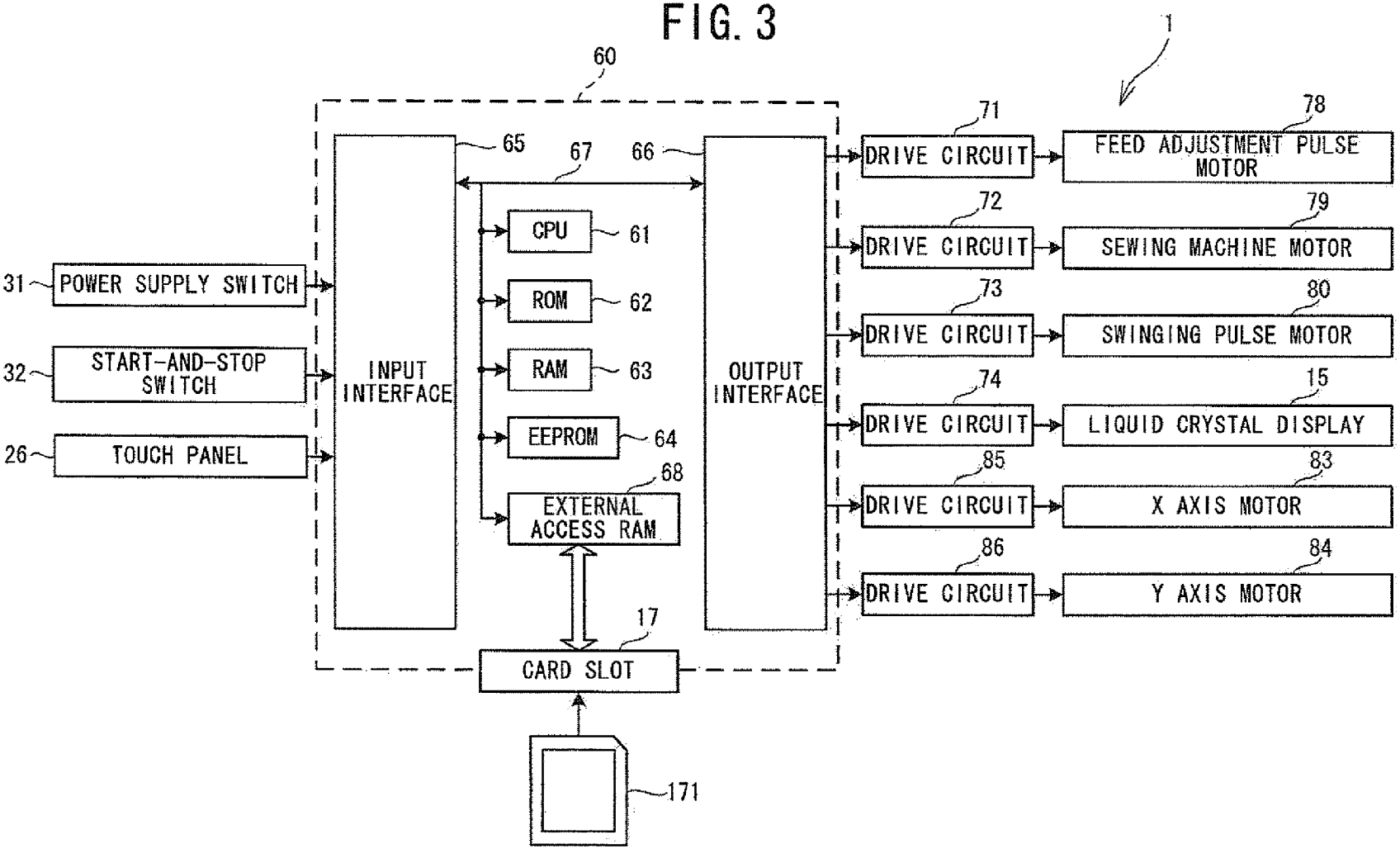
FIG. 3 is a block diagram that shows an electrical configuration of the sewing machine 1.

As shown in FIG. 3, a memory card 171 can be inserted into the card slot 17. The CPU 61 is able to acquire, through the external access RAM 68, information that is stored in the memory card 171. In the present embodiment, the user may store in the memory card 171 image data which represents an image that contains at least one character in a desired style, in order for the at least one character in the desired style to be sewn as an embroidery pattern by the sewing machine 1. The at least one character in the desired style may be a character that is handwritten by the user, a character that is prepared in a font of the user's own devising, or the like. The CPU 61 may acquire the image data that is stored in the memory card 171. Then the CPU 61 may create embroidery data for sewing, as an embroidery pattern, each of the characters that are contained in the image represented by the image data. The embroidery data may be created based on the setting information that is included in the standard character embroidery data that are stored in the ROM 62. The method for creating the embroidery data will be described in detail later. The created embroidery data may be stored in the EEPROM 64.

Drive circuits 71 to 74, 85, and 86 are electrically connected to the output interface 66. The drive circuit 71 may drive a feed adjustment pulse motor 78. The drive circuit 72 may drive a sewing machine motor 79. The drive circuit 73 may drive a swinging pulse motor 80. The swinging pulse motor 80 may drive a needle bar swinging mechanism (not shown in the drawings) that swings the needle bar 6. The feed adjustment pulse motor 78 and the swinging pulse motor 80 are not driven during the sewing of the embroidery pattern. The drive circuit 74 may drive the LCD 15. The drive circuits 85 and 86 may respectively drive the X axis motor 83 and the Y axis motor 84 for moving the embroidery frame 34.

Character acquisition processing and sewing processing that are performed by the sewing machine 1 will be explained with reference to FIGS. 5 to 15. The character acquisition processing is processing that creates an embroidery data based on image data of at least one character that is stored in the memory card 171. The sewing processing is processing that performs the sewing of an embroidery pattern based on the created embroidery data. Hereinafter, each type of processing will be explained in detail.

Figure 5:
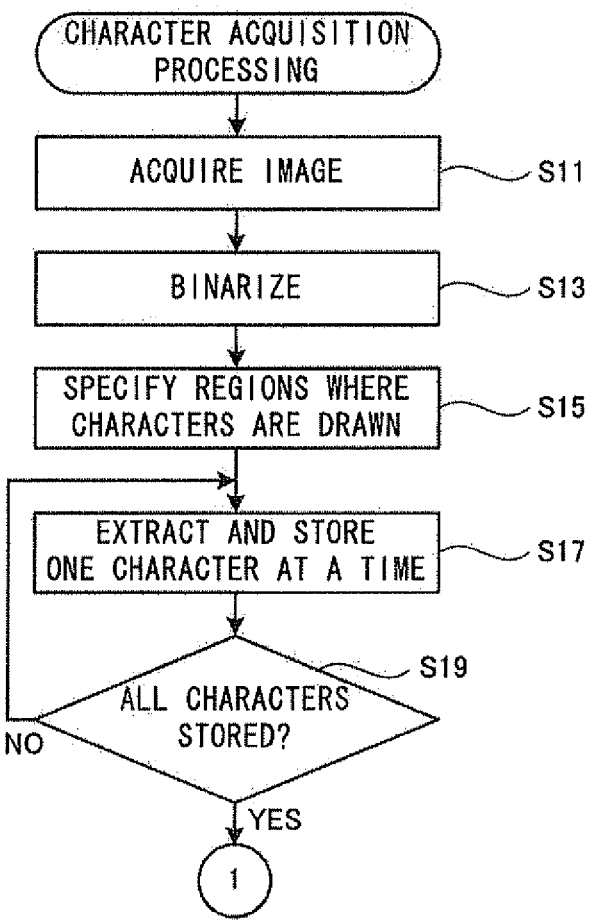
FIG. 5 is a flowchart of character acquisition processing.
Figure 6:
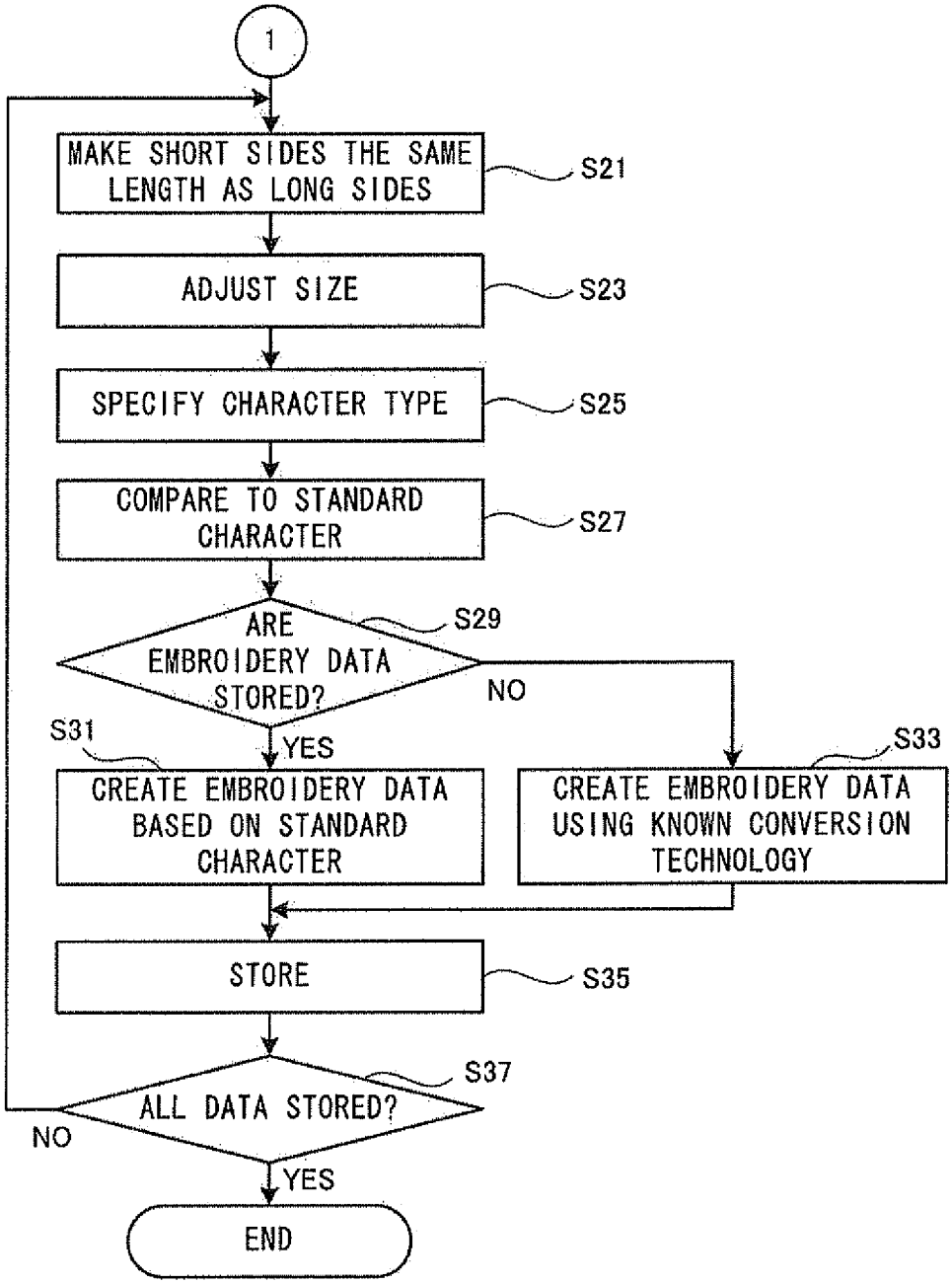
FIG. 6 is a flowchart of the character acquisition processing, continued from FIG. 5.
Figure 7:
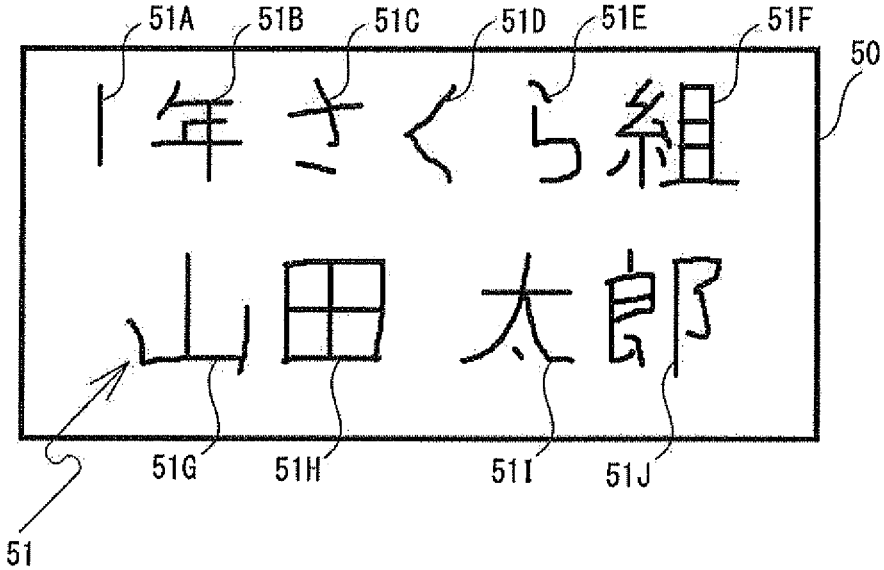
FIG. 7 is a figure that shows an image 50 and characters 51.

The character acquisition processing will be explained with reference to FIGS. 5 and 6. The character acquisition processing is started by the launching of a character acquisition processing program that is stored in the ROM 62, the program being launched in a case where the memory card 171 has been inserted into the card slot 17. The character acquisition processing in FIGS. 5 and 6 is performed by the executing of the program by the CPU 61. As shown in FIG. 5, first, the image data that is stored in the memory card 171 is acquired (Step S11). The acquired image data is stored in the RAM 63. In the explanation that follows, which references FIGS. 7 to 10, an example will be used in which image data of an image 50 shown in FIG. 7 is acquired and stored in the RAM 63. The image 50 contains ten characters 51 (a character 51A, a character 51B, a character 51C, a character 51D, a character 51E, a character 51F, a character 51G, a character 51H, a character 51I, and a character 51J) that were handwritten by the user. Note that the characters 51 include an Arabic numeral, plus Japanese hiragana and kanji character.

As shown in FIG. 5, the image data of the image 50 (refer to FIG. 7) that is stored in the RAM 63 is converted into binary image data of a binary image 70 (refer to FIG. 8) in order for the characters 51 (refer to FIG. 7) that are contained in the image 50 to be recognized (Step S13). Various types of known methods can be used as the method for converting the image data of the image 50 into the binary image data of the image 70. For example, a method that binarizes according to a threshold value can be used. Other examples of methods that can be used include a random dither method and an error diffusion method. Converting the image data of the image 50 into the binary image data of the image 70 makes the differences in the gray levels clearer between the areas where the characters 51 are and the areas outside the characters 51, so it makes the characters 51 that are contained in the image 50 easier to recognize.

Figure 8:
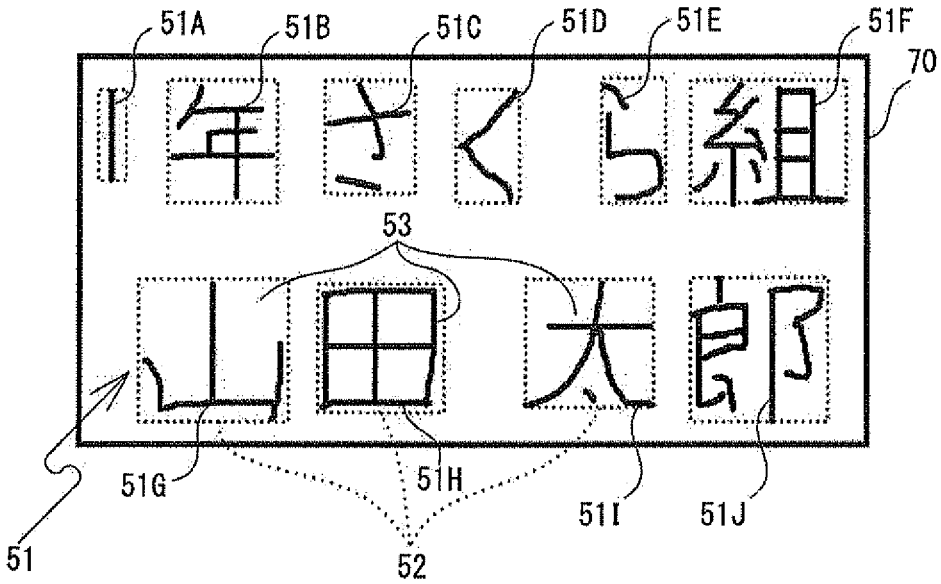
FIG. 8 is a figure that shows a binary image 70 and character designs 53.
Figure 9:
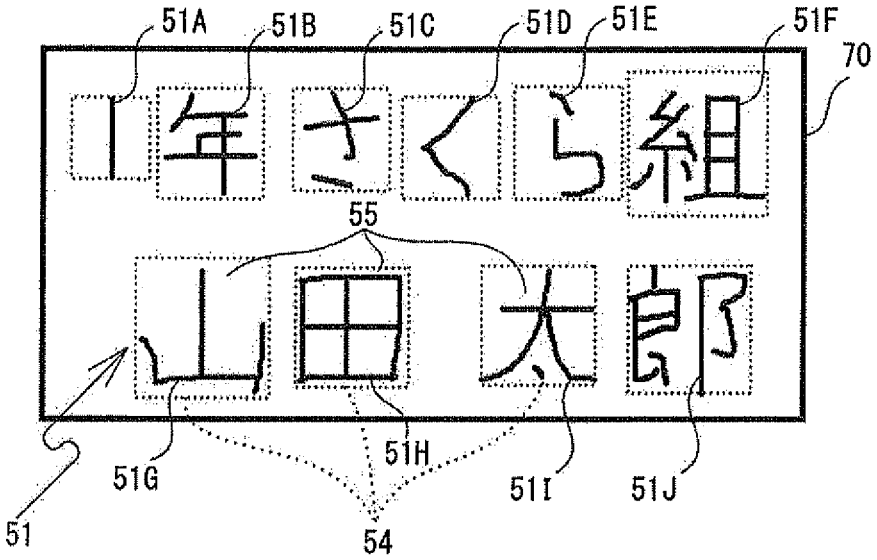
FIG. 9 is a figure that shows character designs 55.
Figure 10:
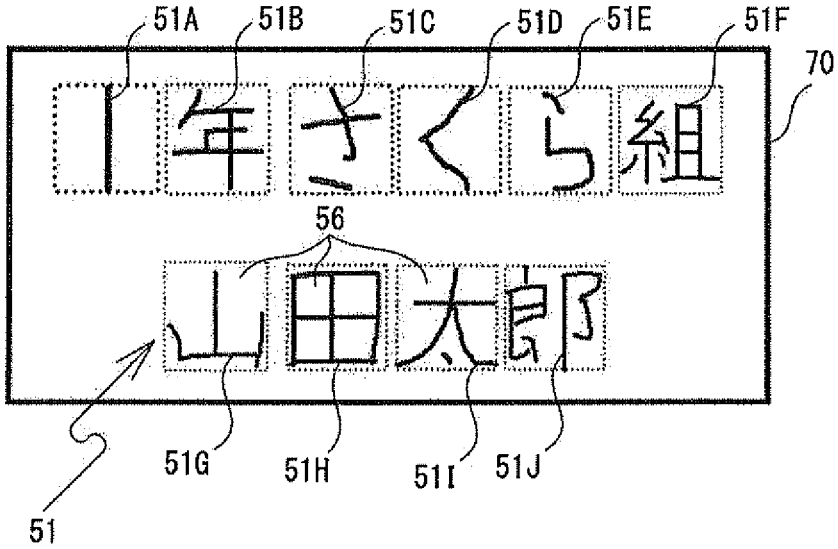
FIG. 10 is a figure that shows character designs 56.

The characters 51 that are contained in the binary image 70 (refer to FIG. 8) are recognized by using a known character recognition method. The regions in which the characters 51 are respectively drawn in the binary image 70 are specified for each individual character 51 (Step S15). Pattern matching by a superposition technique, for example, can be used as the known character recognition method. A rectangle 52 (refer to FIG. 8) is defined that is the smallest rectangle that encloses on all sides the region in which the individual character 51 is drawn. One of the regions in which one of the characters 51 is drawn is extracted from the binary image 70 according to the outline of the defined rectangle 52, and image data of the extracted region is stored in the RAM 63 (Step S17). Hereinafter, the design that indicates the image data of the extracted individual character will also be called a character design 53 (refer to FIG. 8). Note that because the rectangle 52 is the smallest rectangle that encloses on all sides the region in which the individual character 51 is drawn, cases may occur in which the vertical length and the horizontal length of the individual character design 53 are different, as shown in FIG. 8. As shown in FIG. 5, a determination is made as to whether the extracting of the character design 53 and storing the image data of the extracted character design 53 in the RAM 63 have been carried out for all of the characters 51 that are contained in the binary image 70 (Step S19). In a case where a characters 51 remains for which the extracting of the character design 53 and its storing in the RAM 63 have not been carried out (NO at Step S19), the processing returns to Step S17. The processing at Step S17 is repeated for the remaining character 51.

In a case where the extracting and storing have been completed for all of the characters 51 that are contained in the binary image 70 (YES at Step S19), the image data of the first one of the plurality of character designs 53 that have been stored in the RAM 63 is selected, as shown in FIG. 6. A character design 55 (refer to FIG. 9) is produced by making the lengths of the short sides of the rectangular character design 53 equal to the lengths of the long sides of the character design 53 (Step S21). In other words the character design 55 is produced by redefining the character design 53 in accordance with a square 54 (refer to FIG. 9), each of whose sides is equal to the long side of the rectangle 52 that was defined by the processing at Step S17. The short sides of the rectangular character design 53 are lengthened equally, either toward the top and bottom or toward the left and right, so the character 51 that is contained in the character design 55 is positioned in the center of the square 54. The shape of the character 51 that is contained in the character design 53 and the character design 55 is not changed.

The size of the character design 55 is adjusted. Specifically, in a case where the length of one side of the square 54 that contains the character design 55 is not a specified value, the character design 55 is one of enlarged and shrunk such that the length of one side of the square 54 becomes the specified value (Step S23). The character design 55 whose size has been adjusted is then redefined as a character design 56 (refer to FIG. 10). Because the size of the character design 55 is one of enlarged and shrunk, the size of the character 51 that is contained in the character design 55 is also changed accordingly. Thus the character design 56 thus produced has the same size as the other character designs 56 that are respectively produced from all the other character designs 55. Note that in a case where the length of one side of the square 54 that contains the character design 55 is the specified value, the size of the character design 55 is not changed, and the unchanged character design 55 is redefined as the character design 56.

The character 51 that is contained in the character design 56 is recognized by a known character recognition method, and the type of the character 51 is specified (Step S25). Pattern matching by feature extraction, for example, can be used as the known character recognition method. The specified character is compared to a standard character that is sewn according to the standard character embroidery data that are stored in the ROM 62 (Step S27). A determination is made as to whether the standard character embroidery data for a character that is the same as the specified character are stored in the ROM 62 (Step S29). In the present example, a determination is made as to whether the standard character embroidery data are stored in the ROM 62 for a character that is the same as whichever one of the character 51A, the character 51B, the character 51C, the character 51D, the character 51E, the character 51F, the character 51G, the character 51H, the character 51I, and the character 51J (refer to FIG. 7) is currently being processed.

In a case where the standard character embroidery data for the same character that is the same as the specified character are not stored in the ROM 62 (NO at Step S29), the image data of the character design 56 is converted using a known conversion technology, and the embroidery data for sewing the character design 56 as an embroidery pattern are created (Step S33). The embroidery data for the character design 56 are stored in the EEPROM 64 (Step S35). The processing advances to Step S37.

The embroidery pattern that is sewn based on the embroidery data that have been created using the known conversion technology will be explained. With the known conversion technology, a character is ordinarily divided into block units. The setting information (the sewing order, the sewing starting point, and the sewing ending point) that is included in the embroidery data is set such that the sewing will be performed with adjacent blocks being taken into account. The blocks are sections into which the character is divided by curving portions. That means that even where it is possible to sew the character as if it were written as a single continuous line, in many cases the character is actually sewn in part. Therefore, cases may occur in which the quality of the embroidered pattern is affected by differences in the sewing direction and boundary lines that are formed within the character. Furthermore, with the known conversion technology, the sewing starting point and the sewing ending point are set such that the sewing is started at the upper left of the character, and the sewing ends at any chosen point in the character. Therefore, a case may occur in which a jump stitch passes over the embroidered character.

Figure 11:
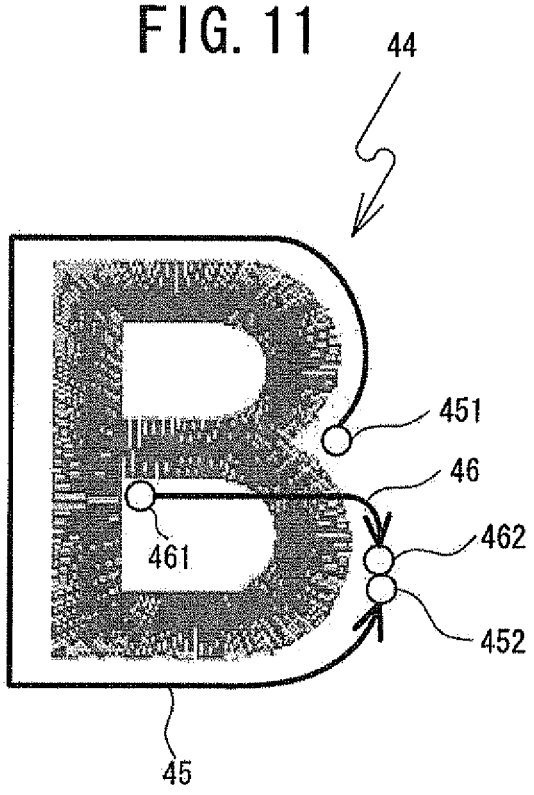
FIG. 11 is a figure that shows an embroidery pattern 44 of a character "B"

FIG. 11 shows an embroidery pattern 44 of the alphabetic character "B" as an example of an embroidery pattern that is sewn based on the embroidery data that have been created using the known conversion technology. The embroidery pattern 44 is sewn by causing the sewing needle 7 to pierce the work cloth 100 at the needle drop points in the order that is indicated by arrows 45, 46, which is based on the sewing order that is contained in the embroidery data. Values are set that indicate positions of a starting point 451 of the arrow 45 and a starting point 461 of the arrow 46 as the sewing starting points. In the same manner, values are set that indicate positions of an ending point 452 of the arrow 45 and an ending point 462 of the arrow 46 as the sewing ending points. Unlike the embroidery pattern 41 of the alphabetic character "B" (refer to FIG. 4), which is sewn based on the standard character embroidery data, the embroidery pattern 44 is divided at the position where the ending point 452 of the arrow 45 and the ending point 462 of the arrow 46 meet. A boundary line is therefore formed at that position. Furthermore, because the ending point 462 of the arrow 46 is positioned higher than the bottom edge of the character, in a case where embroidery patterns are sewn in which a plurality of characters are combined with the alphabetic character "B" to form a character string, a jump stitch between the embroidered patterns for the individual characters may pass over the embroidered pattern.

On the other hand, as shown in FIG. 6, in a case where the standard character embroidery data for the same character as that of the character that was specified are stored in the ROM 62 at Step S25 (YES at Step S29), the embroidery data for sewing the character design 56 as an embroidery pattern are created based on the setting information that is included in the standard character embroidery data (Step S31). Specifically, the setting information that is included in the embroidery data that are created is almost equal to the setting information that is included in the standard character embroidery data. Therefore, in a case where the sewing is performed based on the created embroidery data, the sewing order, the sewing starting point, and the sewing ending point respectively match the sewing order, the sewing starting point, and the sewing ending point that are included in the standard character embroidery data. As was explained with reference to FIG. 4, the setting information (the sewing order, the sewing starting point, and the sewing ending point) that is included in the standard character embroidery data have been adjusted such that the high quality embroidered pattern can be sewn in the work cloth 100 based on the standard character embroidery data. Therefore, in a case where the embroidery data is created based on the setting information that is included in the standard character embroidery data, the embroidery data make it possible for the character design 56 to be sewn as an embroidered pattern with high quality. The embroidery data that are created for the individual character are stored in the EEPROM 64 (Step S35). The processing advances to Step S37.

At Step S37, a determination is made as to whether the processing at Steps S21 to S35 has been performed for all image data of character designs 53 that were stored in the RAM 63 at Step S17 (refer to FIG. 5) (Step S37). In a case where image data of a character design 53 remains in the RAM 63 for which the processing has not been performed (NO at Step S37), the processing returns to Step S21. In a case where the processing has been performed for all image data of character designs 53 were stored in the RAM 63 (YES at Step S37), the embroidery data for sewing as embroidery patterns all of the characters 51 that are contained in the image 50 have been created character by character. The character acquisition processing is terminated.

Figure 12:
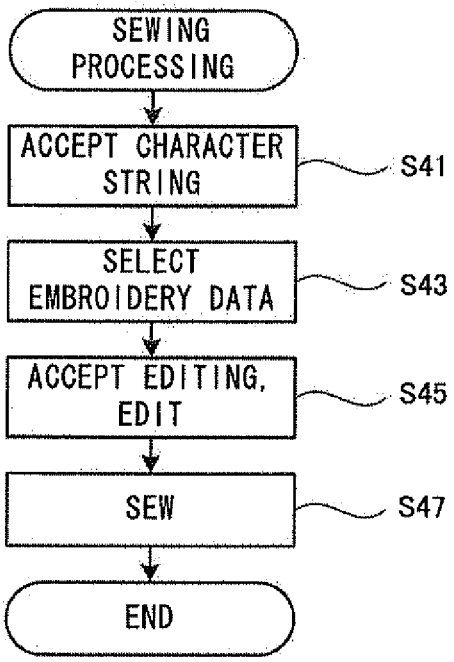
FIG. 12 is a flowchart of sewing processing.

The sewing processing will be explained with reference to FIG. 12. An explanation will be given below, using a case in which the user first creates a character string in which the character designs 56 (refer to FIG. 10) that were acquired by the sewing machine 1 in the character acquisition processing (refer to FIGS. 5 and 6), are arranged in a desired order, and then sew the character string in the work cloth 100 as an embroidery pattern. The sewing processing is started by the launching of a sewing processing program that is stored in the ROM 62, the program being launched in a case where a command to perform sewing of an embroidery pattern is input by the user through the touch panel 26 (refer to FIG. 1). The sewing processing is performed by the executing of the program by the CPU 61.

First, in a case where the user's desired character string is input through the touch panel 26, the input character string is accepted (Step S41). The characters that are included in the accepted character string are specified. The embroidery data for sewing the specified characters as embroidery patterns are selected from among the embroidery data that were stored in the EEPROM 64 at Step S35 in the character acquisition processing (refer to FIG. 6) (Step S43). For example, the user inputs a character string in which the ten characters 51 (the character 51A, the character 51B, the character 51C, the character 51D, the character 51E, the character 51F, the character 51G, the character 51H, the character 51I, and the character 51J) that are contained in the image 50 (refer to FIG. 7) are arranged in the same order as in the image 50. In this case, the embroidery data for sewing, as embroidery patterns, each of the characters 51A to 51J that are included in the input character string, respectively, are selected from the EEPROM 64.

Figure 13:
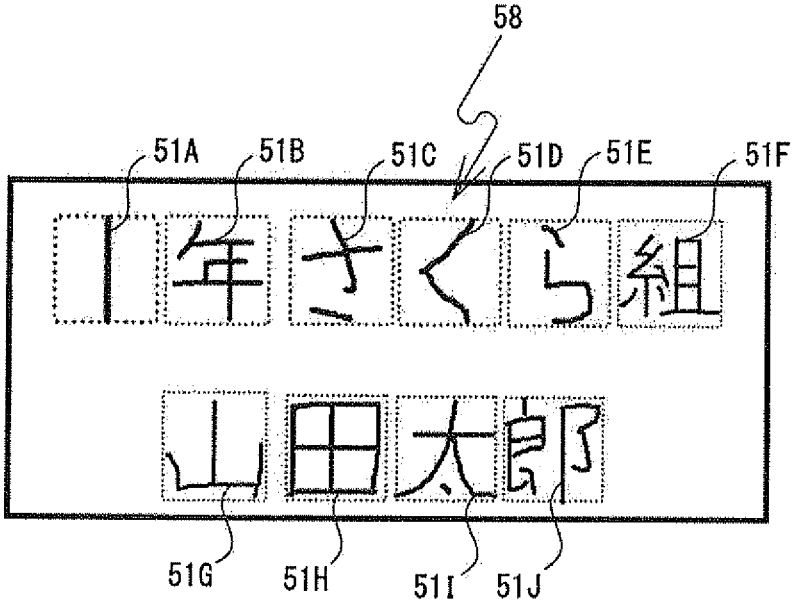
FIG. 13 is a figure that shows an embroidery pattern 58 that has been sewn.

Next, in a case where the user performs, through the touch panel 26, an operation that edits the character string, the content of the editing is accepted (Step S45). The content of the editing may include alignment of the characters, adjustment of the embroidery position, rotation, and the like, for example. In accordance with the accepted editing content, edit processing is performed on the embroidery data that were selected at Step S43 (Step S45). The sewing of the embroidery patterns is performed by controlling the various types of motors based on the edited embroidery data (Step S47). The result, as shown in FIG. 13, is that an embroidery pattern 58 is sewn in the work cloth 100, the embroidery pattern 58 including the character designs 56 (refer to FIG. 10) that were acquired by the character acquisition processing (refer to FIG. 5) and that include the characters 51A to 51J. The sewing processing is then terminated.

Figure 14:
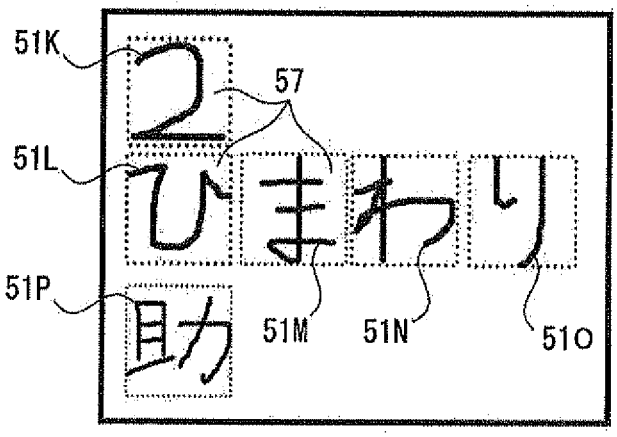
FIG. 14 is a figure that shows character designs 57.

Now, another case will be given in which in addition to the image data of the image 50 (refer to FIG. 7), image data of an image that is different from the image 50 has been acquired from the memory card 171 (refer to FIG. 3) in the character acquisition processing (refer to FIGS. 5 and 6). In this case, based on the acquired image data, embroidery data has been created for sewing, as embroidery patterns, character designs 57 that are shown in FIG. 14, and that the created embroidery data has been stored in the EEPROM 64. Thus, the embroidery data for sewing, as embroidery patterns, the character designs 56, which include the characters 51A to 51J (refer to FIG. 10), and the character designs 57, which include a character 51K, a character 51L, a character 51M, a character 51N, a character 51O, and a character 51P (refer to FIG. 14), have been stored in the EEPROM 64 character by character.

Figure 15:
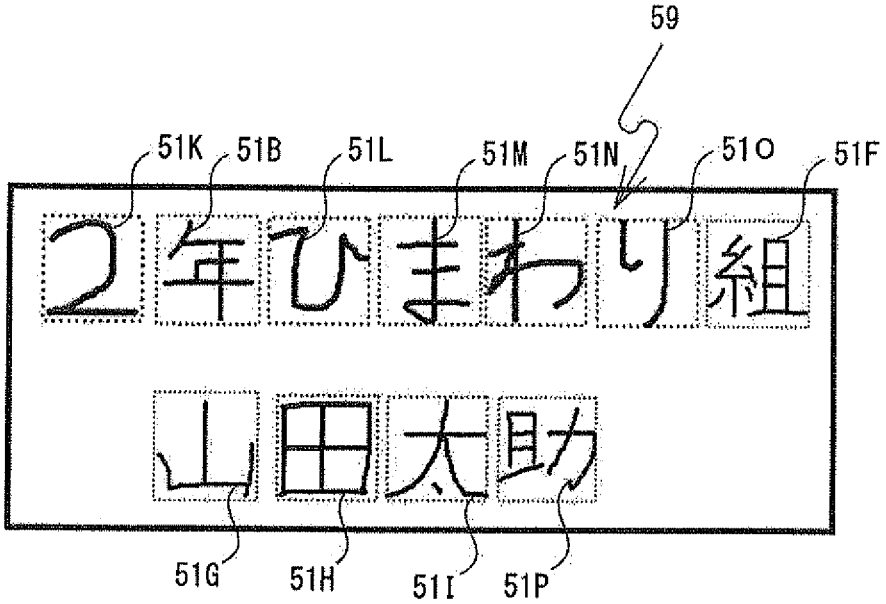
FIG. 15 is a figure that shows an embroidery pattern 59 that has been sewn.

For example, the character 51K, the character 51B, the character 51L, the character 51M, the character 51N, the character 51O, the character 51F, the character 51G, the character 51H, the character 51I, and the character 51P (refer to FIGS. 10 and 14) are accepted at Step S41 as the character string that the user desires. Of the characters 51A to 51J in the character designs 56 (refer to FIG. 10) that were created based on the image data of the image 50, in this character string, the character 51A is replaced by the character 51K, while the character 51C, the character 51D, and the character 51E are replaced by the character 51L, the character 51M, the character 51N, and the character 51O, and the character 51J is replaced by the character 51P. In this sort of case, the embroidery data that correspond to the individual characters that are included in the accepted character string are selected, character by character, from the embroidery data that are stored in the EEPROM 64 (Step S43), and after the edit processing (Step S45), the sewing of the embroidery pattern is performed (Step S47). The result, as shown in FIG. 15, is that an embroidery pattern 59 is sewn in the work cloth 100, the embroidery pattern 59 including the character designs 56, 57 that were acquired by the character acquisition processing and that include the character 51K, the character 51B, the character 51L, the character 51M, the character 51N, the character 51O, the character 51F, the character 51G, the character 51H, the character 51I, and the character 51P.

As explained above, the sewing machine 1 is able to extract, character by character, the characters 51 that are contained in the acquired image 50 without changing the style of the characters 51 (Step S17), and is able to sew the embroidery patterns for the character designs 56 of the extracted characters 51 (Step S47). Therefore, the user is able to sew an embroidery pattern of a character that is not registered in the sewing machine 1 in advance, such as a character that is handwritten by the user or a character that is prepared in a special font, for example. Because the embroidery data are created character by character (Step S17), the sewing machine 1 is also able to easily sew an embroidery pattern in which a plurality of character designs 56 are combined as the user desires (Steps S41 to S47). Even in a case where the sizes of the characters that are contained in the image 50 are not uniform, the sewing machine 1 creates the character designs 56 such that the character sizes are the same (Step S23) and creates the embroidery data (Step S31) that make it possible to sew the embroidery pattern. Therefore, in a case where the embroidery pattern that is sewn is of a character string in which a plurality of characters are positioned side by side, the characters can be sewn in a uniform size, so an attractive embroidery pattern that shows unity as a whole can be sewn. Note that the embroidery data are created after the character designs 56 have been adjusted by making the sizes of the character designs 55 uniform. Therefore, the sizes of the embroidery patterns to be sewn can be reliably made uniform.

The sewing machine 1 is also able to create the embroidery data based on the standard character embroidery data (Step S31), so it is able to sew the embroidery pattern with a good finish. Specifically, the sewing machine 1 is able to make the setting information (the sewing order, the sewing starting point, and the sewing ending point) for the embroidery pattern of the character designs 56 resemble the setting information of the standard character embroidery data. This makes it possible for the sewing machine 1 to sew the embroidery pattern with an even better finish.

The sewing machine 1 can also create embroidery data of a character string by selecting from the EEPROM 64 (Step S43) the embroidery data for the embroidery patterns of the character designs 56 that were created character by character in accordance with a character string that was input. Therefore, by using the sewing machine 1, the user can freely create a character string that includes characters in a desired style and can perform the embroidering of the embroidery patterns for that character string.

Note that the present disclosure is not limited to the embodiment that is described above, and various types of modifications can be made. The sewing machine 1 may also always use a known conversion method to create the embroidery data for sewing the character designs 56 as embroidery patterns, without referring to the standard character embroidery data that are stored in the ROM 62. The setting information that is included in the standard character embroidery data is not limited to being the sewing order, the sewing starting point, and the sewing ending point. Instead of creating the embroidery data after the sizes of the character designs 56 have been modified, the sewing machine 1 may first create the embroidery data based on the unmodified character designs 56, then change the embroidery data such that the sizes of the embroidery patterns to be sewn according to the embroidery data are changed. The sewing machine 1 may also acquire the standard character embroidery data from a server or the like to which the sewing machine 1 is connected through a network.

The present disclosure may also be implemented in an embroidery data creation device that creates the embroidery data. The embroidery data creation device may be configured as a general-purpose computer, for example. In the embroidery data creation device, the embroidery data may be created by the performing of the character acquisition processing (refer to FIGS. 5 and 6). The created embroidery data may be acquired by the sewing machine 1 through the memory card 171 or the like. The sewing machine 1 may perform the sewing of the embroidery pattern based on the acquired embroidery data.

In the embodiment that is described above, the image data of the image 50 that is stored in the memory card 171 is acquired, and the character designs 56 are extracted. The image data of the image 50 may also be acquired by another method. For example, in a case where the sewing machine 1 is connected to a camera or a scanner, the sewing machine 1 may acquire the image data from the camera or the scanner. In a case where the embroidery data are created in the sewing machine 1 based on a plurality of character designs in which the characters are the same, the sewing machine 1 may also be made such that the user can select the embroidery data that are based on the desired character designs.

The setting information in the standard character embroidery data may also be made such that the user can adjust it. For example, the sewing machine 1 may be made such that the user can set the setting information in the embroidery data manually in a case where the standard character embroidery data for characters that are the same as the characters in the created character designs have not been stored in the ROM 62. The sewing machine 1 may also create the embroidery data for sewing the character designs as the embroidery patterns based on the setting information that has been set.

In a case where the standard character embroidery data for characters that are the same as the characters in the created character designs have not been stored in the ROM 62, the sewing machine 1 may also create the embroidery data for sewing the character designs as the embroidery patterns based on the setting information that is included in the standard character embroidery data for other characters whose shapes resemble those of the characters in the character designs.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a processor; and a memory configured to store:

one or more standard character embroidery data that represents an embroidery data of a standard design of a character and includes setting information; and computer-readable instructions that instruct the sewing machine to execute steps comprising:

acquiring image data including one or more characters;

extracting, from the acquired image data, one or more character designs with respect to each character included in the acquired image data, wherein the character design represents each character included in the acquired image data;

identifying one or more characters represented by the extracted one or more character designs;

generating embroidery data with respect to each character based on the extracted character design and the stored setting information, which is included in the standard character embroidery data corresponding to the identified character, wherein the embroidery data represents an embroidery pattern in a predetermined size;

selecting specific embroidery data, in response to accepting an instruction for specifying a character design, from the generated embroidery data corresponding to the specified character design; and generating a signal based on the selected embroidery data, wherein the sewing machine is configured to sew an embroidery pattern represented by the selected embroidery data based on the signal.

2. The sewing machine according to claim 1, wherein the setting information includes a sewing order, a sewing starting point, and a sewing ending point.

3. The sewing machine according to claim 1, wherein the computer-readable instructions further instruct the sewing machine to execute steps comprising:

adjusting a size of the extracted character design to a predetermined size;

wherein generating the embroidery data comprises generating the embroidery data with respect to each character based on the adjusted character design.

4. The sewing machine according to claim 1, wherein the computer-readable instructions further instruct the sewing machine to execute steps comprising:

storing the generated embroidery data in the memory;

wherein, selecting the specific embroidery data comprises selecting specific embroidery data, in response to accepting an instruction for combining the extracted character designs, from the stored embroidery data in the memory.

5. An apparatus comprising:

a processor; and a memory configured to store:

one or more standard character embroidery data that represents an embroidery data of a standard design of a character and includes setting information; and computer-readable instructions that instruct the apparatus to execute steps comprising:

acquiring image data including one or more characters;

extracting, from the acquired image data, one or more character designs with respect to each character included in the acquired image data, wherein the character design represents each character included in the acquired image data;

identifying one or more characters represented by the extracted one or more character designs; and generating embroidery data with respect to each character based on the extracted character design and the stored setting information, which is included in the standard character embroidery data corresponding to the identified character, wherein the embroidery data represents an embroidery pattern in a predetermined size.

6. The apparatus according to claim 5, wherein the setting information includes a sewing order, a sewing starting point, and a sewing ending point.

7. The apparatus according to claim 5, wherein the computer-readable instructions further instruct the apparatus to execute steps comprising:

adjusting a size of the extracted character design to a predetermined size;

wherein generating the embroidery data comprises generating the embroidery data with respect to each character based on the adjusted character design.

8. A non-transitory computer readable medium storing computer readable instructions that, when executed, instruct an apparatus, which comprises a memory configured to store one or more standard character embroidery data that represents an embroidery data of a standard design of a character and includes setting information, to execute steps comprising:

acquiring image data including one or more characters;

extracting, from the acquired image data, one or more character designs with respect to each character included in the acquired image data, wherein the character design represents each character included in the acquired image data;

identifying one or more characters represented by the extracted one or more character designs; and generating embroidery data with respect to each character based on the extracted character design and the stored setting information, which is included in the standard character embroidery data corresponding to the identified character, wherein the embroidery data represents an embroidery pattern in a predetermined size.

9. The non-transitory computer readable medium according to claim 8, wherein the setting information includes a sewing order, a sewing starting point, and a sewing ending point.

10. The non-transitory computer readable medium according to claim 8, wherein the computer readable instructions further instruct the apparatus to execute steps comprising:

adjusting a size of the extracted character design to a predetermined size;

wherein generating the embroidery data comprises generating the embroidery data with respect to each character based on the adjusted character design.

* * * * *